US007887027B2

(12) United States Patent
Garceau et al.

(10) Patent No.: US 7,887,027 B2
(45) Date of Patent: Feb. 15, 2011

(54) FENCE GUARD

(76) Inventors: Fernand Garceau, 209, Parent, Lachenaie (Terrebonne), Quebec (CA) J6W 5Y3; Maurice Garceau, 860, 4e Avenue, Ils Bizard, Quebec (CA) H9C 1J7

( * ) Notice: Subject to any disclaimer, the term of this patent is extended or adjusted under 35 U.S.C. 154(b) by 168 days.

(21) Appl. No.: 12/230,815

(22) Filed: Sep. 5, 2008

(65) Prior Publication Data

US 2009/0134376 A1 May 28, 2009

(51) Int. Cl.
*E04H 17/00* (2006.01)

(52) U.S. Cl. ..... 256/1; 24/336

(58) Field of Classification Search ..... 256/1, 256/32; 248/316.7; 24/297, 336
See application file for complete search history.

(56) References Cited

U.S. PATENT DOCUMENTS

| | | | | | |
|---|---|---|---|---|---|
| 1,683,049 | A | * | 9/1928 | Penley | 24/332 |
| 3,395,428 | A | * | 8/1968 | Schnabel | 24/67.11 |
| 3,436,108 | A | * | 4/1969 | Van Buren, Jr. | 52/489.1 |
| 3,676,952 | A | * | 7/1972 | Watts | 47/33 |
| 3,724,128 | A | * | 4/1973 | Tabone | 47/33 |
| 3,964,197 | A | * | 6/1976 | Tucker et al. | 40/584 |
| 3,991,980 | A | * | 11/1976 | Blackburn | 256/45 |
| 4,340,144 | A | * | 7/1982 | Cousins | 211/106.01 |
| 4,497,472 | A | * | 2/1985 | Johnson | 256/32 |
| 4,515,349 | A | * | 5/1985 | Groves | 256/1 |
| 4,582,284 | A | * | 4/1986 | Veenstra | 248/220.21 |
| 4,663,883 | A | * | 5/1987 | Hilliard et al. | 47/33 |
| 4,690,382 | A | * | 9/1987 | Koperdak | 256/1 |
| 4,723,761 | A | * | 2/1988 | Cluff | 256/34 |
| 4,725,044 | A | * | 2/1988 | Cluff | 256/34 |
| 4,903,947 | A | * | 2/1990 | Groves | 256/32 |
| 4,907,783 | A | * | 3/1990 | Fisk et al. | 256/32 |
| 4,953,817 | A | * | 9/1990 | Mosteller | 248/222.51 |
| 4,964,619 | A | * | 10/1990 | Glidden, Jr. | 256/32 |
| 4,995,591 | A | * | 2/1991 | Humphrey et al. | 256/34 |
| 5,039,065 | A | * | 8/1991 | Denton | 256/1 |
| 5,178,369 | A | * | 1/1993 | Syx | 256/32 |
| 5,328,156 | A | * | 7/1994 | Hoke | 256/32 |
| 5,732,921 | A | * | 3/1998 | Lemire | 248/317 |
| D417,807 | S | * | 12/1999 | McBarnette | D6/513 |
| 6,070,859 | A | * | 6/2000 | Damon et al. | 256/1 |
| 6,637,074 | B1 | * | 10/2003 | Morris | 24/3.12 |
| 7,004,458 | B1 | * | 2/2006 | Grubba et al. | 256/1 |
| 7,628,385 | B2 | * | 12/2009 | Laird | 256/1 |
| 2004/0069919 | A1 | * | 4/2004 | Studer | 248/301 |
| 2005/0274937 | A1 | * | 12/2005 | Moore | 256/1 |

* cited by examiner

*Primary Examiner*—Joshua T Kennedy
(74) *Attorney, Agent, or Firm*—Christian Cawthorn; Ogilvy Renault LLP

(57) ABSTRACT

A fence guard mountable to a chain link fence includes a generally elongated shield and a mounting clip. The mounting clip includes a clip-to-fence attachment for attaching the clip to the fence and an adjustable shield-to-clip attachment for adjustably attaching the shield to the mounting clip. The shield-to-clip attachment allows for vertical adjustment of the position of the shield relative to the position of the mounting clip. The vertical adjustability of the shield relative to the mounting clip provides vertical adjustment of the position of the shield relative to the position of the fence lower edge when the shield is mounted to the mounting clip and the mounting clip is mounted to the fence.

12 Claims, 7 Drawing Sheets

FENCE GUARD

FIELD OF THE INVENTION

The present invention relates to the general field of fences and is particularly concerned with a fence guard.

BACKGROUND OF THE INVENTION

Various types of fences are used to delineate property boundaries and to restrict either access to or egress out of properties or areas. A particularly popular type of fence is the so-called chain-link type of fence.

Chain-link fences typically include a matrix or web of interwoven wires defining square or diamond-shaped openings. The matrix is supported in a substantially vertical orientation by fence posts that are secured in the ground at regularly spaced intervals.

It is usually intended and desired that the bottom of the fence extend close to the ground so as to provide a barrier to entry or exit of small animals. However, there are several limitations as to how close to the ground the fence can be placed, especially if there are changes in the contour of the ground around the fence. Accordingly, there typically exists a gap between the fence lower edge of a fence and the ground. In some situations, such as when there is considerable undulation or changes in the contour of the ground along the fence, the configuration of the gap may vary to a point where it becomes unsightly or to the point where the fence loses, at some locations, its ability to prevent entry or exit of smaller animals.

Accordingly, there exists a need for a fence guard that can be mounted at the lower edge of a fence so as to fill the gap between the lower edge of the fence and the ground surface.

In situations wherein a chain-link fence is erected at a location wherein grass, weed or other vegetation grows, it may prove difficult and time-consuming to trim such vegetation adjacent the fence bottom. While labour-reducing devices such as string trimmers are typically used, the trimming task is still considered tedious. Furthermore, fences tend to wear away the string of such trimmers at a substantial rate. Accordingly, there also exists a need for a fence guard that could serve as a vegetation barrier for inhibiting or preventing the growth of vegetation adjacent the base of a fence.

Some prior art patents disclose so-called fence vegetation shields or fence liners intended to deter the growth of vegetation adjacent the bottom of fences. However, most of the prior art devices suffer from numerous drawbacks. Accordingly, there exists a need for an improved fence guard.

Some of the advantages associated with the present invention include that the proposed fence guard is designed so as to allow for relatively easy adjustment of its position in order to be usable in a variety of situations including a variety of ground contours and fence configurations while maintaining both functions of blocking gaps and deterring vegetation growth.

Furthermore, the proposed fence guard is designed so as to be retrofittable to existing fences of various types or installed with the installation of a new fence.

Furthermore, the proposed fence guard is designed so as to be quickly and easily mountable to a conventional fence through a set of relatively easy steps without requiring special tooling or manual dexterity.

In at least one embodiment of the invention, the proposed fence guard allows for vegetation control on both sides of a fence while the installation occurs only on one side thereof.

Still furthermore, the proposed fence guard is designed so as to be maintained in a biased and tight relationship relative to the fence in order to prevent rattling noises in various conditions such as windy conditions.

Also, the proposed fence guard is designed so as to be aesthetically pleasing. For example, the fastening components thereof are typically concealed when the fence guard is installed.

Yet, still furthermore, in at least some embodiments of the invention, the proposed fence guard is designed so as to distribute water dripping down from the fence to areas adjacent to the fence.

Also, in at least some embodiments of the invention, the proposed fence guard is designed so as to allows the side wheels of a lawn mower to easily climb thereunto and mow along a parallel path relative to the fence guard in order to uniformly cut the vegetation in front of the fence guard at the same height as the rest of the lawn.

Yet, still furthermore, the proposed fence guard is designed so as to be easily manufacturable through conventional forms of manufacture so as to be economically feasible and long lasting.

SUMMARY OF THE INVENTION

In accordance with the present invention, there is provided a fence guard mountable to a fence of the chain link type, the fence including a wire web having fence wires or fence wire strands, the fence wire strands defining fence web apertures, the fence defining a fence lower edge, the fence guard comprising: a generally elongated shield; a mounting clip, the mounting clip including a clip-to-fence attachment for attaching the clip to the fence; an adjustable shield-to-clip attachment for adjustably attaching the shield to the mounting clip; the shield-to-clip attachment allowing for substantially vertical adjustment of the position of the shield relative to the position of the mounting clip; whereby the substantially vertical adjustability of the shield relative to the mounting clip provides substantially vertical adjustment of the position of the shield relative to the position of the fence lower edge when the shield is mounted to the mounting clip and the mounting clip is mounted to the fence.

Conveniently the mounting clip includes a clip body, the shield includes a shield body and the shield body has a shield flange depending therefrom; the shield-to-clip attachment including an attachment tongue extending from the clip body, the attachment tongue defining a tongue inner surface and an opposed tongue outer surface, the tongue inner surface being provided with at least two locking recesses; a locking prong extending from the shield flange; whereby the locking prong is selectively insertable in one of the at least two locking recesses for selectively adjusting the position of the shield relative to the mounting clip.

Preferably, the clip-to-fence attachment allows for substantially vertical adjustment of the position of the mounting clip once the latter is mounted on the fence; whereby the substantially vertical adjustability of the mounting clip relative to the fence provides further adjustability of the position of the shield relative to the fence lower edge when the shield is mounted to the mounting clip and the mounting clip is mounted to the fence.

BRIEF DESCRIPTION OF THE DRAWINGS

Embodiments of the present invention will now be disclosed, by way of example, in reference to the following drawings in which.

DETAILED DESCRIPTION

Figure 1:
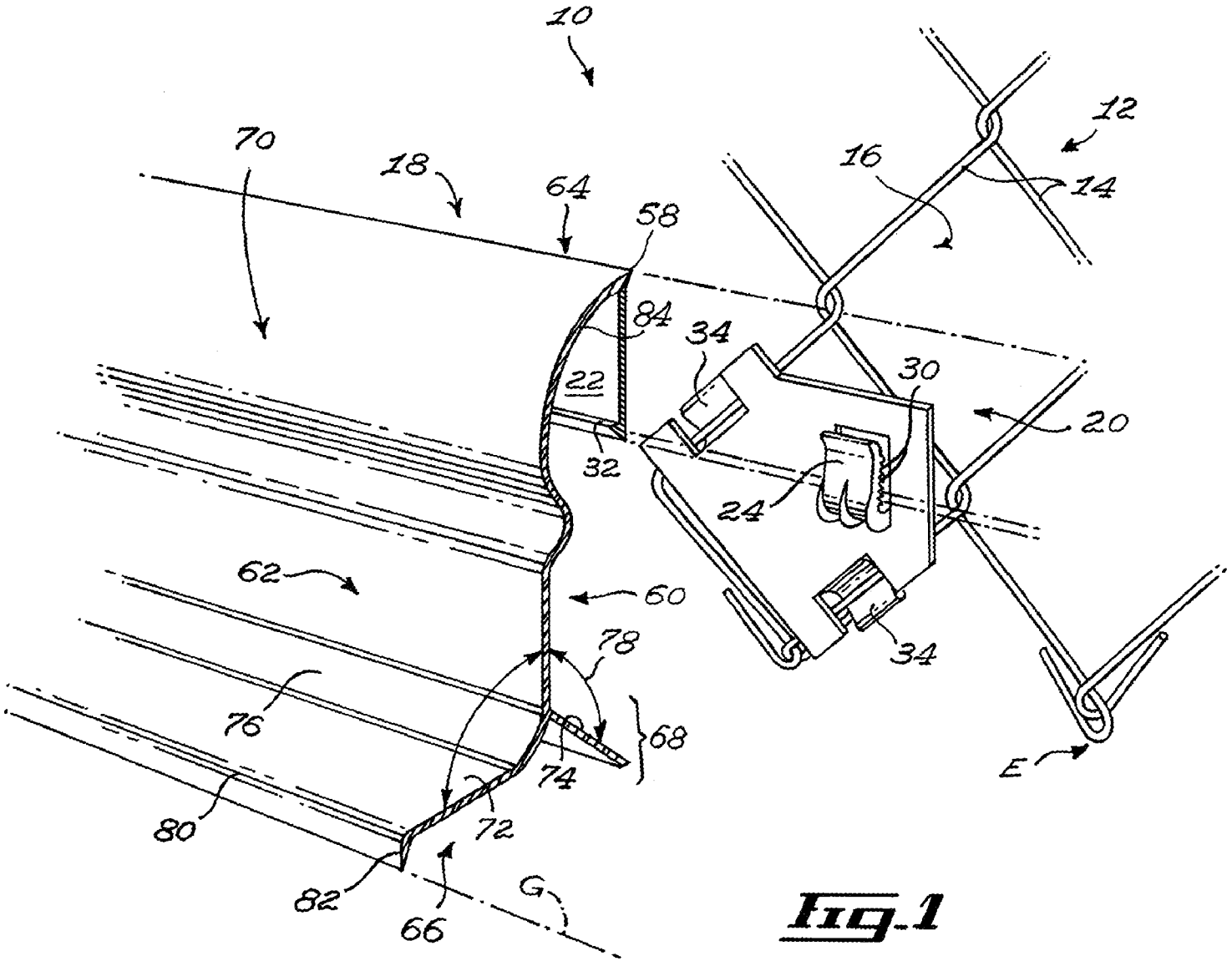
FIG. 1: in a partial perspective view with sections taken out, illustrates a fence guard in accordance with an embodiment of the present invention, the fence guard being shown mounted to a bottom portion of a conventional chain-link fence.

Referring to FIG. 1, there is shown a fence guard generally indicated by the reference numeral 10 in accordance with an embodiment of the present invention. The fence guard 10 is shown mounted to a conventional chain-link fence 12. It should however be understood that the fence guard 10 could be mounted to other suitable types of fences without departing from the scope of the present invention.

The chain-link fence 12 includes a web or matrix of interwoven wires 14. The wires 14 define substantially square or diamond-shaped apertures 16. The fence 12 defines a fence lower edge generally designated by the letter E. When the fence 12 is anchored to the ground, typically using fence posts (not shown), the fence lower edge E is typically spaced from a ground surface, generally designated by the letter G.

In general terms, the fence guard 10 includes a generally elongated shield having a shield body 18 and a mounting clip having a clip body 20. The mounting clip, in turn, includes a clip-to-fence attachment for attaching the clip to the fence 12 and an adjustable shield-to-clip attachment for adjustably attaching the shield to the mounting clip. As shown more specifically in FIG. 2, the shield-to-clip attachment allows for substantially vertical adjustment of the position of the shield relative to the position of the mounting clip.

Figure 5:
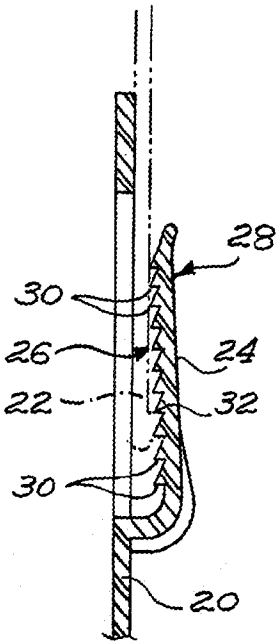
FIG. 5: in a partial cross-sectional view taken along arrows V-V of FIG. 3, illustrates an attachment tongue part of the mounting clip shown in FIGS. 3 and 4.

The shield body 18 has a shield flange 22 depending therefrom. The shield-to-clip attachment typically includes an attachment tongue 24 extending from the clip body 20. As shown more specifically in FIG. 5, the attachment tongue 24 defines a tongue inner surface 26 and an opposed tongue outer surface 28. The tongue inner surface 26 is provided with at least two locking recesses 30. Typically, the tongue inner surface 26 is serrated with a plurality of substantially saw-tooth shaped recesses.

A locking prong 32 extends from the shield flange 22. The locking prong 32 is selectively insertable in a given locking recess 30 for selectively adjusting the position of the shield body 18 relative to the clip body 20.

The clip-to-fence attachment allows for substantially vertical adjustment of the position of the clip body 20 once the latter is mounted on the fence 16. Hence, the substantially vertical adjustability of the clip body 20 relative to the fence 12 provides further adjustability of the position of the shield body 18 relative to the fence lower edge E when the shield body 18 is mounted to the clip body 20 and the clip body 20 is mounted to the fence 12.

The clip-to-fence attachment typically includes at least one and preferably two or four attachment tabs 34 extending from the clip body 20. As shown more specifically in FIG. 6, each attachment tab 36 extends from the clip body 20 so as to define a tab-to-clip body spacing 38 between the corresponding attachment tab 36 and the clip body 20.

Figure 2:
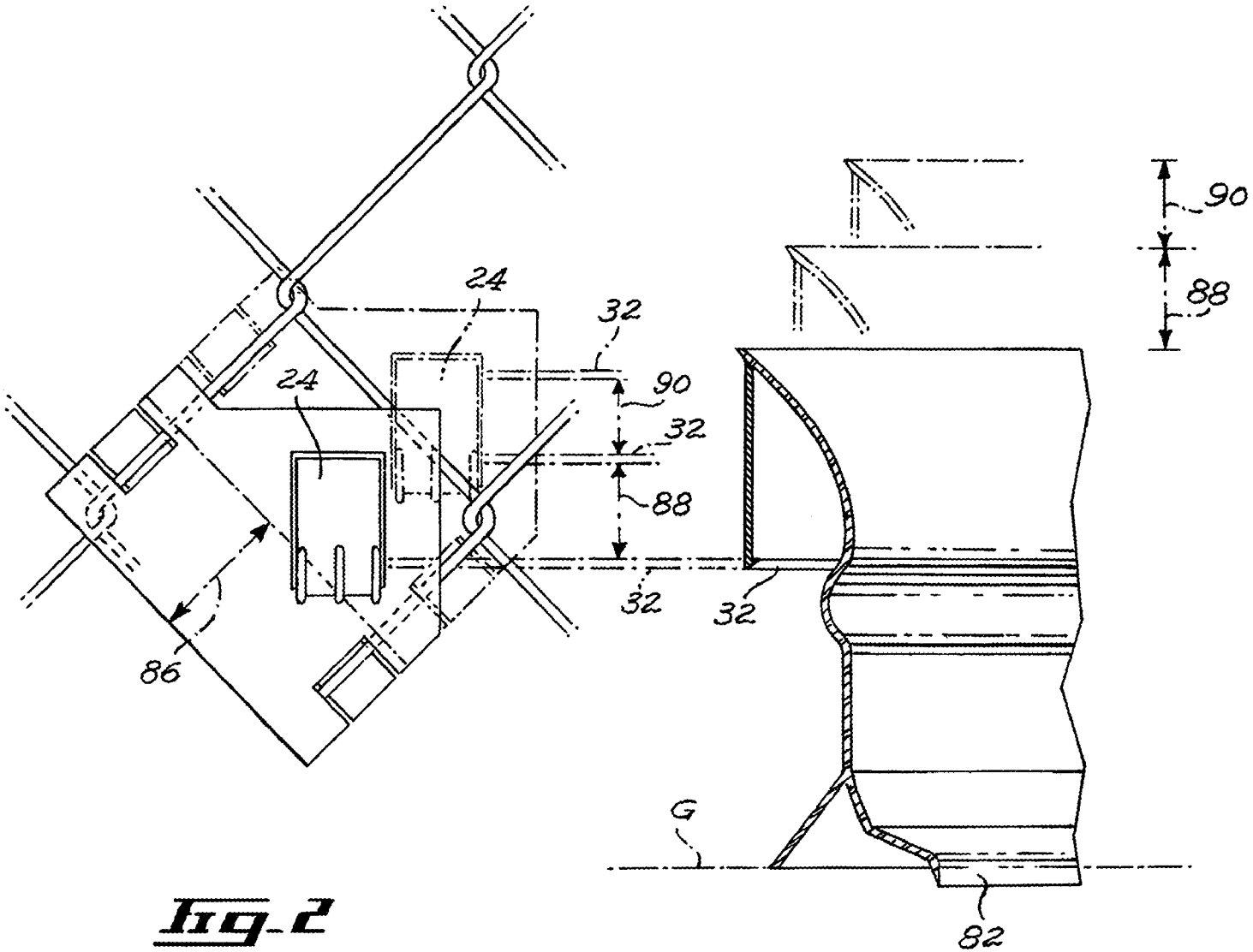
FIG. 2: in a partial elevational view with sections out, illustrates the fence guard shown in FIG. 1 mounted to the bottom portion of a chain-link fence, phantom lines being used to show the adjustability of the position of the fence guard relative to the fence.
Figure 6:
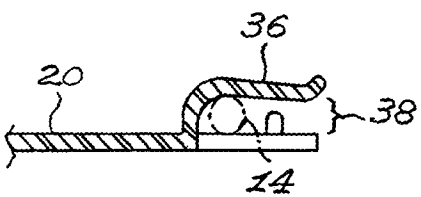
FIG. 6: in a partial cross-sectional view taken along arrows VI-VI of FIG. 4, illustrates an attachment tab part of the mounting clip shown in FIGS. 3 and 4.

Each tab-to-clip body spacing 38 is configured and sized for receiving therein a portion of one of the fence wires 14 and selectively allowing slidable movement of a corresponding fence wire 14 therein so as to allow selective adjustment of the position of the clip body 20 relative to the fence 12, as shown in FIG. 2. As shown in FIG. 6, each tap-to-clip body spacing 38 is typically sized so as to provide a substantially snug fit for the wires 14.

Figure 3:
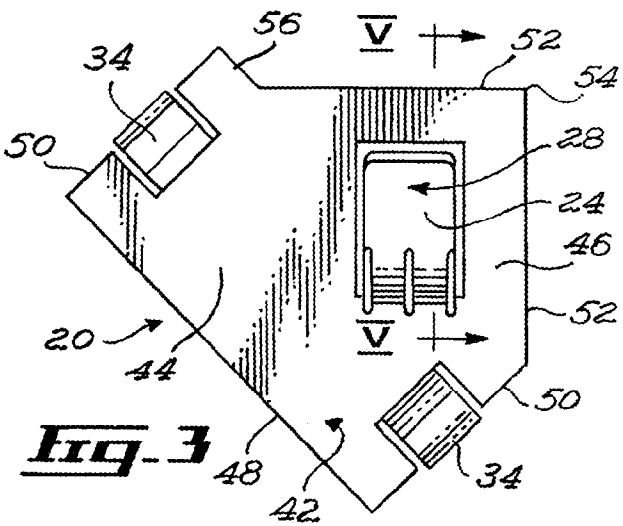
FIG. 3: in a front elevational view, illustrates a mounting clip part of a fence guard in accordance with an embodiment of the present invention.
Figure 4:
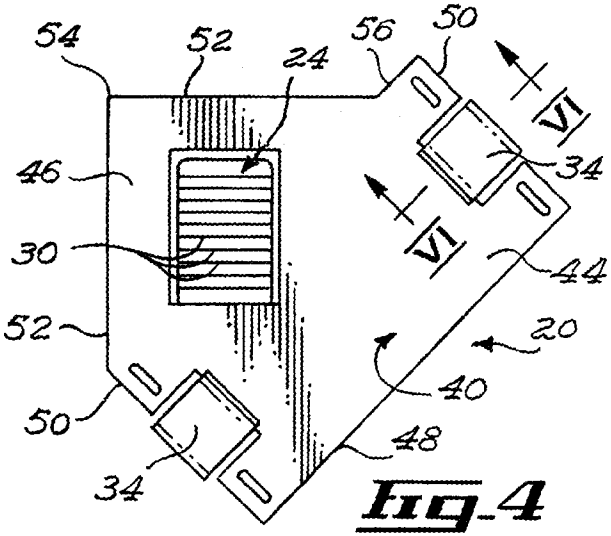
FIG. 4: in a rear elevational view, illustrates the mounting clip shown in FIG. 3.
Figure 10:
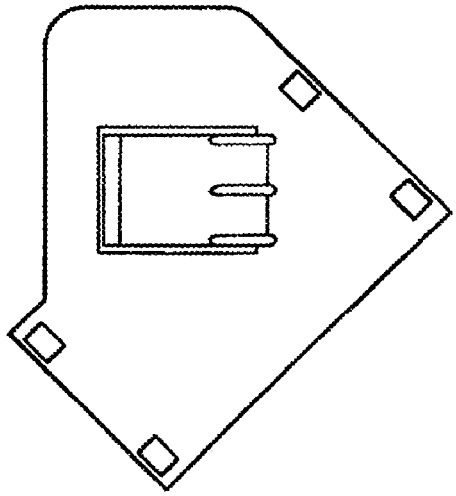
FIG. 10: in a rear elevational view, illustrates the mounting clip shown in FIGS. 7 through 9.
Figure 9:
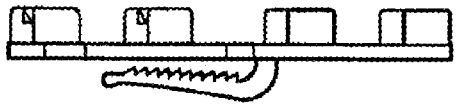
FIG. 9: in a side view, illustrates the mounting clip shown in FIGS. 7 and 8.
Figure 7:
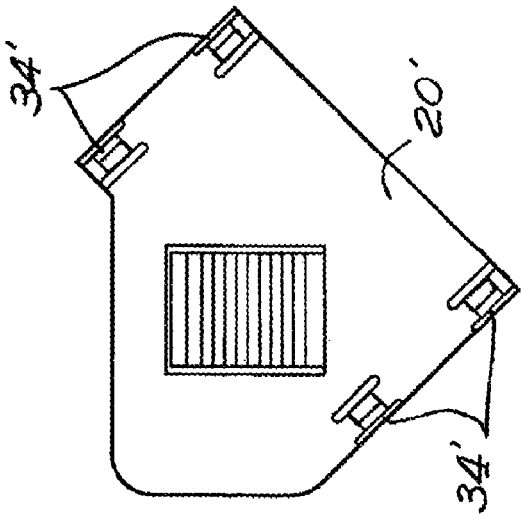
FIG. 7: in a front elevational view, illustrates a mounting clip in accordance with an alternative embodiment of the invention.

The clip body 20 defines a clip body first surface 40 shown in greater details in FIG. 4 and an opposed clip body second surface 42 shown in greater details in FIG. 3. Typically, the attachment tabs 34 extend from the clip body first surface 40 while the attachment tongue 24 extends from the clip body second surface 42.

The clip body 20 defines a clip body peripheral edge. Typically, the attachment tabs 34 extend from the clip body first surface 40 in a substantially adjacent relationship relative to the clip body peripheral edge. Furthermore, the attachment tabs 34 are typically positioned so as to form pairs of substantially opposed attachment tabs 34. In the embodiment shown in FIGS. 1, 3 and 4, a pair of attachment tabs 34 is positioned in a substantially opposed relationship relative to each other. In the embodiment shown in FIGS. 7 through 10, two pairs of attachment tabs 34' are positioned in opposite relationships relative to each other.

The mounting clip 20' shown in FIGS. 7 through 10 is substantially similar to the mounting clip 20 shown in FIGS. 1, 3 and 4 and, hence, similar reference numerals are used to denote similar components. One of the main differences between the clip bodies 20 and 20' is that two attachment tabs 34' are used in opposite sides of the clip body 20', the attachment tabs 34' being relatively narrower than the single attachment tabs 34 used on each side of the mounting clip 20.

In the embodiments shown throughout the Figures, the clip body 20 or 20' is configured and sized so that when the clip body 20 is mounted on the fence 12, each tap-to-clip body spacing 38 receives a corresponding fence wire 14.

The clip body 20 typically has a substantially flat configuration. As illustrated more specifically in FIGS. 3 and 4, the clip body 20 defines a substantially rectangular clip body first section 44 extending integrally into a substantially triangular clip body second section 46. The clip body first section 44 defines a peripheral edge first portion 48 and a pair of substantially perpendicular peripheral edge second portions 50.

The clip body second section 46 defines a pair of angled peripheral edge third portions 52 joining each other about a peripheral edge apex 54 located substantially opposite to the peripheral edge first portion 48.

The clip body second section 46 is typically off-center relative to the clip body first section 44 so as to define a peripheral edge fourth portion 56 extending between one of the peripheral edge third portions 52 and an adjacent peripheral edge second portion 50 in a substantially parallel relationship with the peripheral edge first portion 48.

Typically, each of the attachment tabs 34 is located substantially adjacent to a corresponding peripheral edge second portion 50 and the attachment tongue 24 extends in a substantially parallel relationship relative to one of the peripheral edge third portions 52.

The configuration of the clip body peripheral edge shown throughout the Figures is intended to facilitate mounting of the clip body 20 on the fence 12. It should however be understood that mounting clips having other configurations could be used without departing from the scope of the present invention.

As illustrated more specifically in FIG. 1, the shield body 20 is typically provided with an abutment lip 58 extending therefrom for abutting against the fence 12 when the fence guard 10 is mounted on the latter. The fence guard 10 is typically further provided with a biasing component for biasing the abutment lip 58 against the fence 12.

The shield body 18 defines a body first surface 60 and a substantially opposed body second surface 62 for being positioned respectively in a facing and an opposed relationship relative to the fence 12. The shield body 18 also defines a shield body first longitudinal edge 64 and a substantially opposed shield body second longitudinal edge 66 for being positioned respectively in an upper and lower relationship relative to each other when the shield body 18 is mounted on the fence 12. The abutment lip 58 extends substantially away from the shield body first surface 60 and in a substantially proximal relationship relative to the shield body first longitudinal edge 64.

The shield body 18 is made of a shield body material while the abutment lip 58 is made of a lip material. Typically, the lip material is more deformable than the shield body material. The lip material is typically chosen so as to allow the abutment lip 58 to deform for at least partially surrounding the fence wires 14 when biased by the biasing component against the latter. Typically, although by no means exclusively, the lip material is a substantially resiliently deformable material for allowing the biasing lip 58 to act as a shock absorber between the fence guard 10 and the fence 12 when the fence guard 10 is mounted on the fence 12.

Although any suitable biasing means could be used for biasing the abutment lip 58 against the fence 12, typically the attachment tongue 24 is designed so as to provide a biasing force suitable for such purpose.

The shield body 18 defines a shield body base section 68 and an integrally extending shield body main section 70 for being positioned respectively in a lower and upper relationship relative to each other when the shield body 18 is mounted on the fence 12. The shield body base section 68 includes a base section front leg 72 extending substantially frontwardly relative to the shield body main section 70. The shield body base section 68 typically also includes a base section rear leg 74 extending substantially rearwardly relative to the shield body main section 70.

The base section front leg 72 extends from the shield body main section 70 at a front leg-to-main section angle 76 and the base section rear leg 74 extends from the shield body main section 70 at a rear leg-to-main section angle 78. Typically, the front leg-to-main section angle 76 is greater than the rear leg-to-main section angle 78.

In fact, the base section front leg 72 typically includes a substantially horizontal segment. Furthermore, the substantially horizontal segment of the base section front leg 72 is typically sized so as to allow wheels of a conventional lawn mower (not shown) to roll thereon.

The base section front leg 72 defines a front leg proximal end located adjacent the shield body main section 70 and an opposed front leg distal end 80. The base section front leg 72 is typically provided with an anchoring lip 82 depending therefrom. The anchoring lip 82 is configured so as to be insertable into the ground surface G for contributing to the stabilization of the fence guard 10 when the latter is mounted on the fence 12. In fact, the anchoring lip 82 typically collaborates with the base section rear leg 74 for providing a solid ground anchor to the fence guard 10.

The shield body main section 70 typically includes a rearwardly extending main section spacing portion 84. In FIGS. 1 and 2, the main section spacing portion 84 is shown as having a substantially arcuate cross-section configuration. It should, however, be understood that the shield body main section 70 could have any other suitable configuration without departing from the scope of the present invention.

Typically, the shield body 18 is manufactured as a single piece element made out of a suitable polymeric resin. For example, the shield body 18 could be made out of a high density polyethylene, a polyvinyl chloride, a polycarbonate-ABS blend or the like. Similarly, the clip body 12 is typically manufactured as a single piece element and made out of a UV-proof suitable polymeric resin using a conventional moulding process.

Installation of a fence guard 10 on the lower edge E of a chain-link fence 12 typically includes the step of first anchoring a plurality of clip bodies 20 to the fence 12 and then attaching the shield body 18 to the clip bodies 20.

Figure 11:
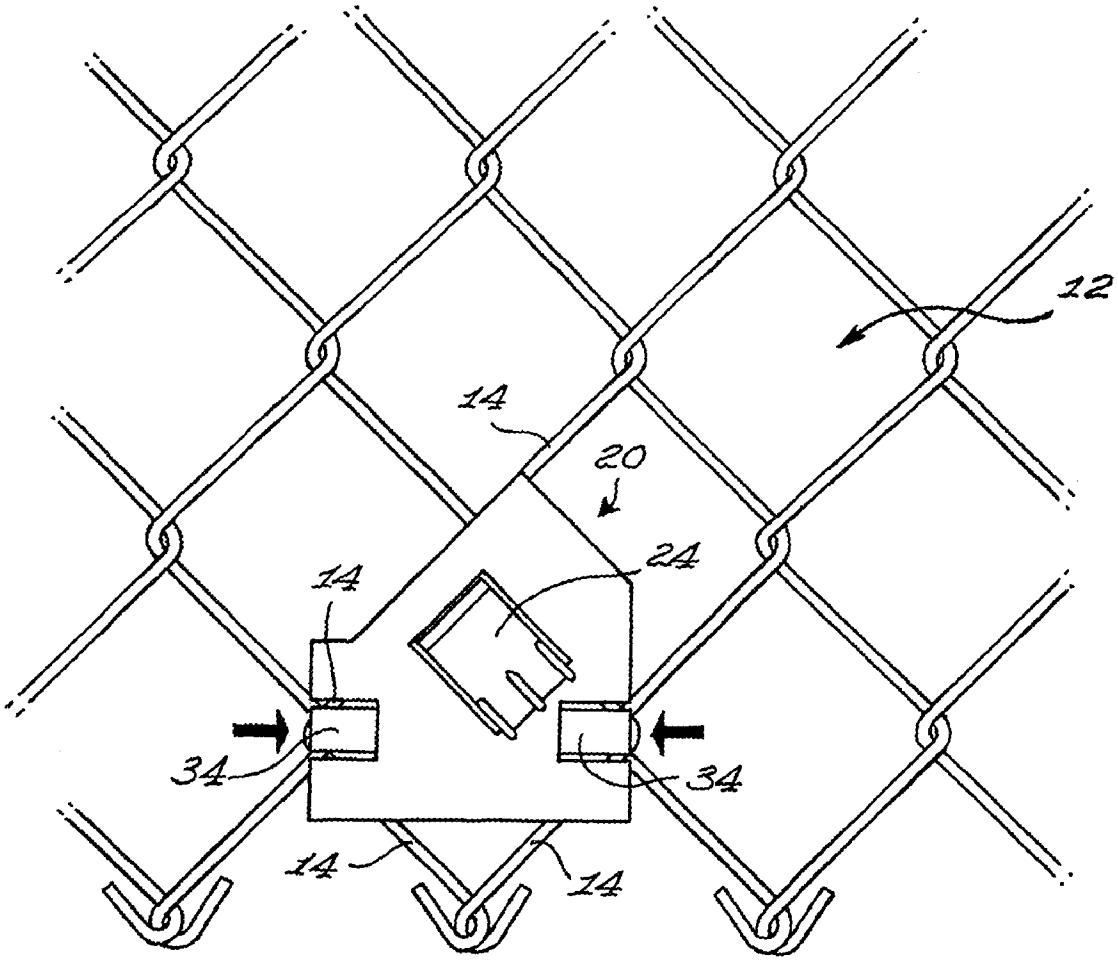
FIGS. 11 through 13: in corresponding elevational views, illustrate sequential steps used for mounting a mounting clip part of a fence guard in accordance with the present invention to a conventional chain-link fence.
Figure 12:
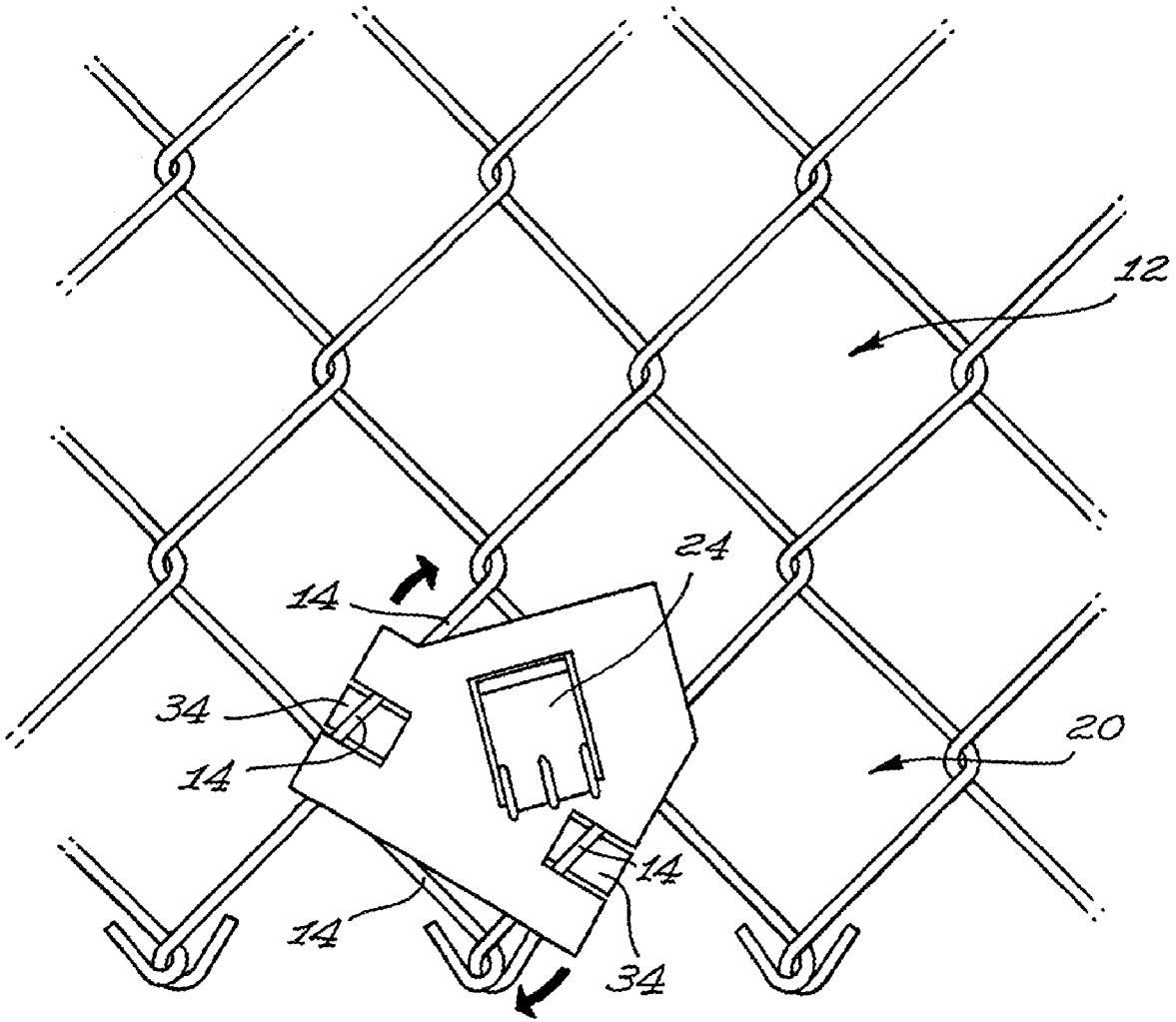
Figure 13:
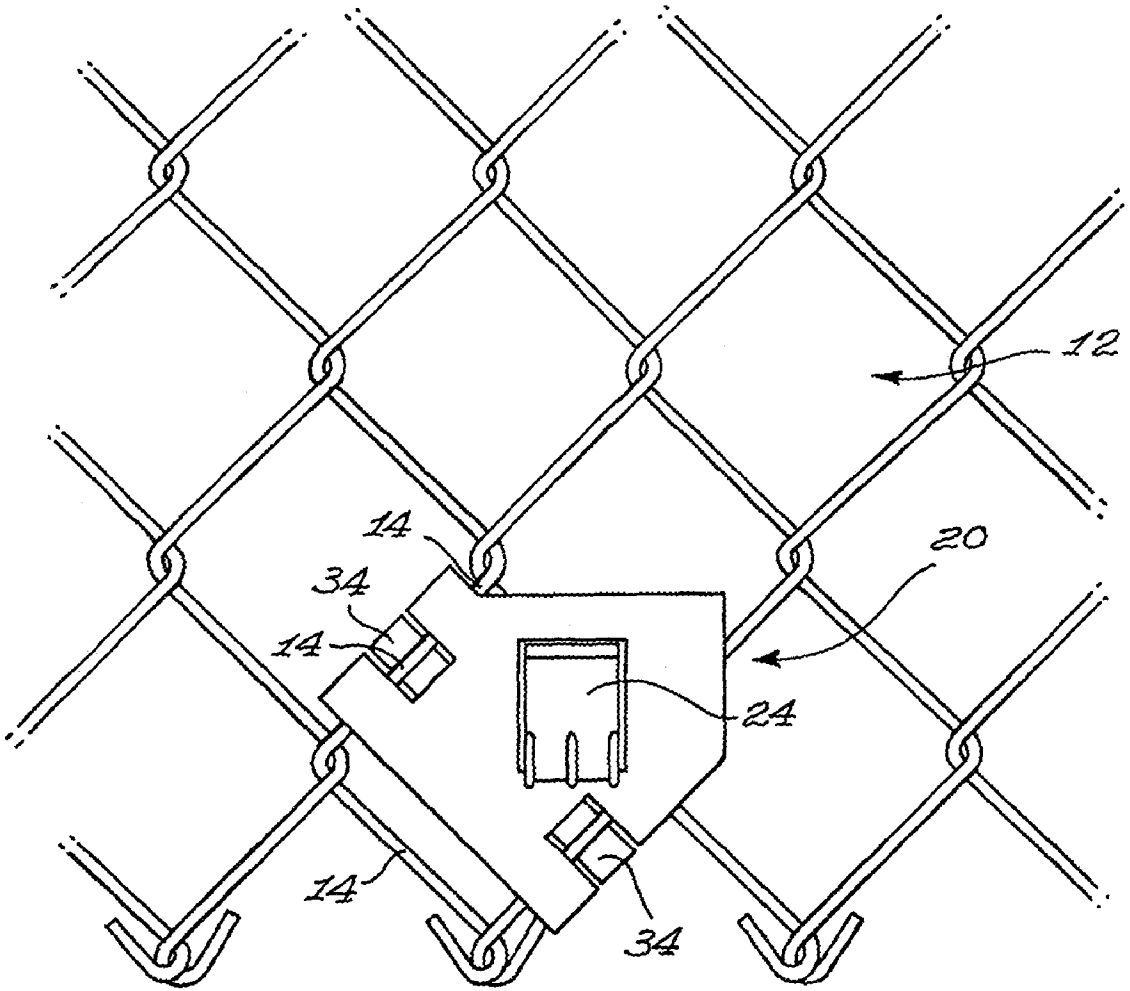

As illustrated more specifically in FIGS. 11 through 13, in order to mount a clip body 20 to a fence 12, a user merely needs to position the clip body 20 against a pair of opposed wires 14. As shown more particularly in FIG. 11, the attachment tabs 36 are typically initially aligned along a substantially horizontal axis. The substantially triangular configuration of the clip body second section 46 may be used as a visual guide for aligning the clip body 20 by positioning the peripheral edge third portions 52 substantially in register with adjacent wires 14.

Figure 8:
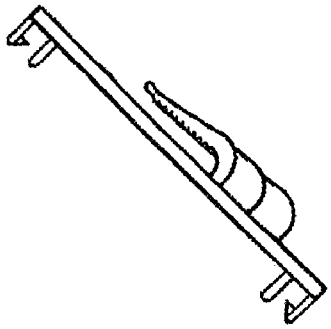
FIG. 8: in a side view, illustrates the mounting clip shown in FIG. 7.

Concurrently, with the upper corner of a first attachment tab 36 slightly engaged behind the lower portion of a first wire 14 and the lower corner of the opposite attachment tab 36 slightly engaged behind the upper portion of the opposite wire 14, the clip body 20 is then turned, typically about an angle substantially in the range of ⅛ of a turn towards the lower wire 14 as shown in FIG. 12. The clip body 20 is typically turned until the peripheral edge second portions 50 reach a substantially parallel relationship with the opposed wires 14, as shown in FIG. 8. In this position, the clip body 20 is firmly anchored to the fence 12 with the open end of the attachment tongue 24 substantially upwardly oriented, ready to receive the shield flange 22.

As mentioned previously, and as illustrated more specifically in FIG. 2, the clip-to-fence attachment allows for substantially vertical adjustment of the position of the mounting clip once the latter is mounted on the fence. As indicated by arrow 86 in FIG. 2, the slidable movement of the clip body 20 along corresponding wire strands 14 allows for a first vertical adjustment indicated by arrows 88.

In FIG. 2, full lines are used to illustrate the clip body 20 in a lowermost position relative to a corresponding aperture 16 and phantom lines are used to illustrate the same clip body 20 in an uppermost position within the same fence aperture 16.

As mentioned previously, the shield-to-clip attachment also allows for substantially vertical adjustment of the position of the shield relative to the position of the fence 12 by providing adjustments of the position of the shield relative to the position of the mounting clip.

By varying the depth of the locking recess 30 in which the locking prong 32 is inserted during mounting of the shield body 18 to the clip body 20, the vertical position of the shield body 18 relative to the clip body 20 may also be adjusted. In FIG. 2, reference numeral 90 is used to denote a vertical adjustment provided by vertical movement of the locking prong 32.

Hence, the choice of fence openings 16 along the lower edge of the fence 12 to which clip bodies 20 are attached combined with the adjustability of the clip bodies 20 along a given fence opening 16 and the selective positioning of the locking prong 32 in a selected locking recess together provide an intended user with an appreciable degree of adjustability when installing the fence guard 10 on a fence 12. This degree of adjustability is particularly useful in a variety of situations including when the fence guard 10 is mounted on the lower edge of, for example, a slightly drooping section of a fence or a level fence overhanging a slightly unlevelled ground surface, or a combination of both.

Furthermore, it is to be noted that, when the shield body 18 is firmly pressed down with its shield flange 22 inserted in the spacing created by the attachment tongue 24, a spring biased interlock configuration occurs between the abutment lip 58 abutting against the fence 12. In this configuration, the shield flange 22 is tightly latched to the clip body 20 anchored to the fence 12 while the shield body 18 is firmly pressing down into the ground surface G. This firm interlocked configuration between the various components allows for a lawn mower to roll along the base section front leg 72. The firm interlock even allows occasional bumping onto the shield body 18 without affecting the latter. The firm interlock reduces the risks of producing rattling sounds during windy conditions. Furthermore, slidable movement of the mounting relative to the fence 12 allows for adaptation during harsh freezing and thawing cycles of winter seasons in some regions. These temperature cycles typically apply cyclical mechanical stresses to outdoor installations.

The abutment lip 58, in cooperative relation with the mounting clip 20 anchored to the fence 12, provides a spring biased means that forces the shield body 18 to abut against the fence 12. The abutment lip 58 typically surrounds at least partially the wires 14 hence allowing the abutment lip to act as a rain water and condensing dew collecting means for collecting drops of water dripping down the wires 14. Once connected the water may flow down the shield body 18 in order to be distributed adjacent the latter.

The embodiments of the invention in which a privilege or property is claimed are defined as follows:

1. A fence guard for blocking a gap between a fence bottom and the ground, comprising:

a generally elongated shield having a shield body, said shield body having a shield flange depending from an upper end thereof, said shield flange having a locking prong extending towards the shield body; and a mounting clip having a clip body having two opposite sides, said mounting clip including on one of said two opposite sides a clip-to-fence attachment for attaching said clip to a fence and on the other of said two opposite sides an adjustable shield-to-clip attachment comprising an attachment tongue extending from said clip body, said attachment tongue comprising at least two vertically spaced locking recesses on an inner face thereof, said locking prong being selectively insertable in one of said at least two locking recesses for selectively adjusting the vertical position of said shield relative to said mounting clip.

2. A fence guard as recited in claim 1, wherein said clip-to-fence attachment includes an attachment tab extending from said clip body so as to define a tab-to-clip body spacing between said attachment tab and said clip body; wherein said tab-to-clip body spacing is configured and sized for receiving therein a portion of a fence wire strands and selectively allowing slidable movement of said one of said fence wire strands therein so as to allow selective adjustment of the position of said mounting clip relative to said fence.

3. A fence guard as recited in claim 1, wherein said clip body defines a clip body peripheral edge, said clip-to-fence attachment including a pair of attachment tabs extending from said clip body in a substantially opposed relationship relative to each other, each of said attachment tabs defining a corresponding tab-to-clip body spacing; said clip body being configured and sized so that when said mounting clip is mounted on a fence, each of said tab-to-clip body spacing receives a corresponding fence wire strand.

4. A fence guard as recited in claim 3, wherein said clip body has a substantially flat configuration, said clip body defining a substantially rectangular clip body first section extending integrally into a substantially triangular clip body second section, said clip body first section defining a peripheral edge first portion and a pair of substantially perpendicular peripheral edge second portions; said clip body second section defining a pair of angled peripheral edge third portions joining each other about a peripheral edge apex located substantially opposite to said peripheral edge first portion; said clip body second section being off-centered relative to said clip body first section so as to define a peripheral edge fourth portion extending between one of said peripheral edge third portions and an adjacent peripheral edge second portion in a substantially parallel relationship with said peripheral edge first portion; each of said attachment tabs being located substantially adjacent to a corresponding peripheral edge second portion and said attachment tongue extending in a substantially parallel relationship relative to one of said peripheral edge third portions; whereby the configuration of said clip body peripheral edge facilitates mounting of said clip body on said fence, said peripheral edge third portions acting as visual guides during initial steps of a mounting procedure.

5. A fence guard as recited in claim 1, wherein said shield is further provided with an abutment lip extending from said shield body for abutting against a fence when said fence guard is mounted on said fence; and a biasing component for biasing said abutment lip against said fence.

6. A fence guard as recited in claim 5, wherein said shield body defines a shield body first surface and a substantially opposed shield body second surface for being positioned respectively in a facing and an opposed relationship relative to a fence, said shield body also defining a shield body first longitudinal edge and a substantially opposed shield body second longitudinal edge for being positioned respectively in an upper and lower relationship relative to each other when said shield is mounted on said fence; said abutment lip extending substantially away from said shield body first surface and in a substantially proximal relationship relative to said shield body first longitudinal edge;

whereby said abutment lip allows for liquids dripping from a fence wire strands to be deflected onto said shield body first surface and to flow thereonto towards said ground surface.

7. A fence guard as recited in claim 5, wherein said shield body is made out of a shield body material and said abutment lip is made out of a lip material, said lip material being more deformable then said shield body material; said lip material allowing said abutment lip to deform so as to at least partially surround a fence wire strands when biased by said biasing component against the latter.

8. A fence guard as recited in claim 7, wherein said lip material is a substantially resiliently deformable material for allowing said abutment lip to act as a shock-absorber between said fence guard and said fence when said fence guard is mounted on said fence.

9. A fence guard as recited in claim 1, wherein said shield has a shield body, said shield body defining a body first surface and a substantially opposed body second surface for being positioned respectively in a facing and an opposed relationship relative to said fence, said shield body also defining a shield body base section and an integrally extending shield body main section for being positioned respectively in lower and upper relationship relative to each other when said shield is mounted on said fence; said shield body main section including a rearwardly extending main section spacing portion, said shield flange extending from said main section spacing portion.

10. A fence guard as recited in claim 9 wherein said main section spacing portion defines a shield body upper peripheral edge, said main section spacing portion being provided with an abutment lip extending therefrom substantially adjacent to said shield body upper peripheral edge for abutting against said fence when said fence guard is mounted on said fence.

11. A mounting clip for attachment to a fence, said mounting clip having a substantially flat clip body having two opposite sides, said mounting clip including i) on one of said two opposite sides a clip-to-fence attachment comprising at least two attachment tabs extending from said clip body on opposing sides of said substantially flat clip body, each of the attachment tabs defining a tab-to-clip body spacing between said attachment tabs and said clip body; wherein said tab-to-clip body spacing is configured and sized for receiving therein a portion of a fence wire strand and selectively allowing slidable movement of said fence wire strand therein so as to allow selective adjustment of the position of said mounting clip relative to said fence, and ii) on the other of said two opposite sides an adjustable shield-to-clip attachment mechanism comprising a biasing attachment tongue extending from said body clip such that upon insertion of a member between the tongue and the body, the tongue is biased to tightly grip the member therebetween, said attachment tongue comprising at least two vertically spaced locking recesses on an inner face thereof providing a vertical adjustment mechanism.

12. A mounting clip as recited in claim 11, said clip body defining a substantially rectangular clip body first section extending integrally into a substantially triangular clip body second section, said clip body first section defining a peripheral edge first portion and a pair of substantially perpendicular peripheral edge second portions; said clip body second section defining a pair of angled peripheral edge third portions joining each other about a peripheral edge apex located substantially opposite to said peripheral edge first portion; said clip body second section being off-centered relative to said clip body first section so as to define a peripheral edge fourth portion extending between one of said peripheral edge third portions and an adjacent peripheral edge second portion in a substantially parallel relationship with said peripheral edge first portion; each of said attachment tabs being located substantially adjacent to a corresponding peripheral edge second portion and said attachment tongue extending in a substantially parallel relationship relative to one of said peripheral edge third portions; whereby the configuration of said clip body peripheral edge facilitates mounting of said clip body on said fence, said peripheral edge third portions acting as visual guides during initial steps of a mounting procedure.

* * * * *